US005660364A

United States Patent [19]

Hsieh

[11] Patent Number: 5,660,364

[45] Date of Patent: Aug. 26, 1997

[54] TOM-TOM HOLDER

[76] Inventor: Wu Hong Hsieh, No. 162, Chungshan 2nd Rd., Luchou Hsiang, Taipei Hsien, Taiwan

[21] Appl. No.: 655,411

[22] Filed: May 30, 1996

[51] Int. Cl.[6] ..... A47F 5/00

[52] U.S. Cl. ..... 248/309.1; 248/314; 248/316.1; 84/421

[58] Field of Search ..... 248/205.1, 222.52, 248/309.1, 558, 316.1, 314; 84/421, 411 A

[56] References Cited

U.S. PATENT DOCUMENTS

| | | | |
|---|---|---|---|
| 3,804,358 | 4/1974 | Gunther | 248/205.1 |
| 4,141,272 | 2/1979 | Yanagisawa | 84/421 |
| 4,158,980 | 6/1979 | Gauger | 84/421 |
| 4,253,633 | 3/1981 | Takegawa | 248/205.1 X |
| 4,367,858 | 1/1983 | Ziaylek, Jr. | 248/314 X |
| 4,453,442 | 6/1984 | LaFlame | 84/421 |
| 5,221,069 | 6/1993 | Struthers et al. | 248/314 X |
| 5,520,083 | 5/1996 | Falkner, Jr. | 84/421 |

*Primary Examiner*—Lanna Mai

*Attorney, Agent, or Firm*—Hedman, Gibson & Costigan, P.C.

[57] ABSTRACT

A tom-tom holder includes a mounting plate for fixedly mounting a tom-tom drum to the tom-tom holder. The mounting plate defines a central slot and two side slots. The tom-tom holder further includes two fastening strips, a fastening plate, a gasket and a cap being connected to the mounting plate by extending screws through the fastening strips, the fastening plate, the side slots defined by the mounting plate, the gasket to be threadedly engage with the cap, a locking plate fixedly connected with the fastening plate, a shaft being extended through the cap, the gasket, the central slot of the mounting plate, the fastening plate and the locking plate and defining a locking tab engaging with a bottom face of the locking plate, and a locking nut being screwed onto a threaded portion defined on the shaft to exert a clamping forge to fixedly and tightly connect the above mentioned for constituting the tom-tom holder in accordance with the present invention together.

7 Claims, 3 Drawing Sheets

TOM-TOM HOLDER

FIELD OF THE INVENTION

The present invention is related to a tom-tom holder, particularly to a tom-tom holder by which the level of a tom-tom drum is relative to a bass drum that the tom-tom drum is mounted thereon and the height of the tom-tom holder is adjustable.

BACKGROUND OF THE INVENTION

A drum outfit generally includes a pair of tom-tom drums, each drum equipped with a tom-tom holder so that the tom-tom drums can be mounted on a base drum. Such a tom-tom holder is well known. However, the conventional tom-tom holder has a disadvantage that it is laborious to manipulate the tom-tom holder to change the level of a tom-tom drum relative to a bass drum that the tom-tom drum is mounted thereon via the tom-tom holder. Thus, inconvenience may be caused when different persons of different heights intend to use a same drum outfit equipped with the conventional tom-tom holder for mounting tom-tom drums on a bass drum.

The present invention therefore is aimed to provide an improved tom-tom holder for a tom-tom drum to mitigate and/or obviate the aforementioned problems.

SUMMARY OF THE INVENTION

It is an objective of the present invention to provide a tom-tom holder by which the level of a tom-tom drum relative to a bass drum that the tom-tom drum is mounted thereon via the tom-tom holder can be easily adjusted.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
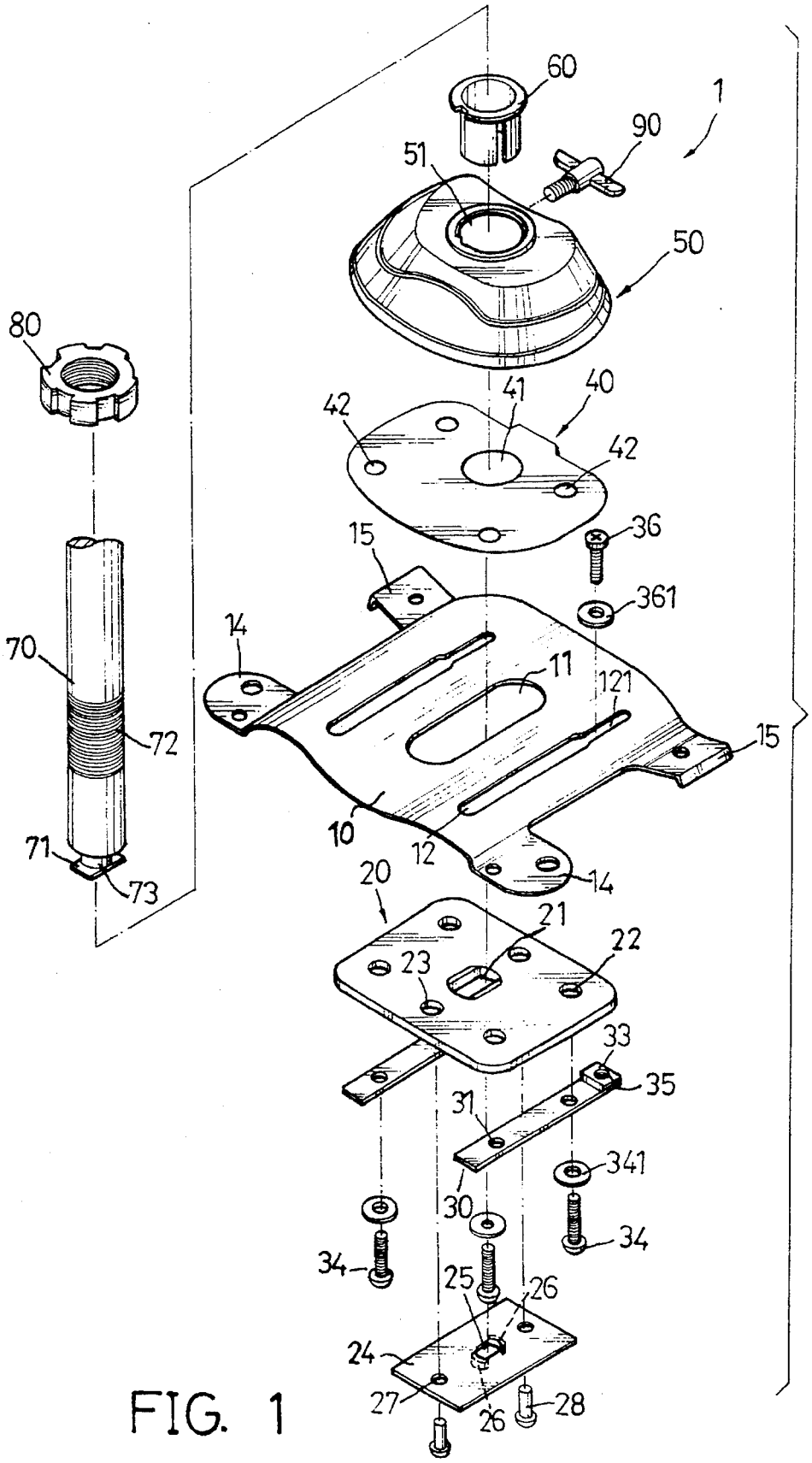
FIG. 1 is an exploded view showing the constituting elements of a tom-tom holder in accordance with the present invention.
Figure 2:
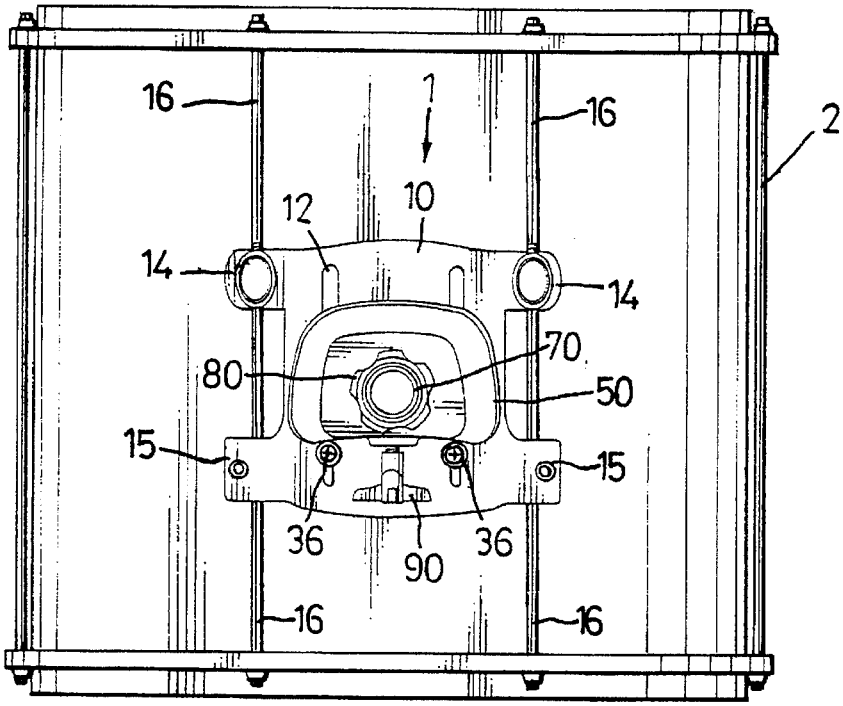
FIG. 2 is plane view showing that the tom-tom holder is in an assembled condition and is mounted on two tensioning fittings on a drum shell.

Referring to FIG. 1, a tom-tom holder in accordance with the present invention is generally indicated by reference number 1. The tom-tom holder 1 generally consists of a mounting plate 10 defining a pair of upper ears 14 and lower ears 15 adapted for connecting two tensioning fittings 16 of a tom-tom drum 2 (FIG. 2) to the tom-tom holder 1 by a known means, a fastening plate 20 defining a central hole 21 generally having a rectangular configuration, four first round holes 22 respectively arranged in four corners thereof and a pair of second round holes 23 respectively arranged on opposite sides of the central hole 21, two fastening strips 30 each defining two round smooth holes 31 therealong and having a block 33 fixedly attached on a lower end thereof and defining a threaded hole 35 through the block 33 and the fastening strip 30, a locking plate 24 defining a central hole 25 having a configuration the same as that of the central hole 21 of the fastening plate 20 and two third round holes 27 respectively arranged on opposite sides of the central hole 25, a gasket 40 defining a central large round hole 41 and four small round holes 42, each respectively arranged in four corners thereof, a cap 50 defining a central round hole 51, a bushing 60, a shaft 70 defining an outer threaded portion 72 and a locking tab 71 on a bottom thereof, and a locking nut 80. The locking tab 71 is connected with the shaft 70 via a neck 73. The locking tab 71 has a configuration meeting that of the central holes 21 and 25 respectively of the fastening plate 20 and the locking plate 24 so that only when the locking tab 71 is lengthwise aligned with the central holes 21 and 25, it can pass through these holes, The mounting plate 10 preferably is formed by pressing a steel plate to have an arcuate configuration. The mounting plate 10 is also formed with a central large slot 11 and two small slots 12 each respectively on either side of the large slot 11. Each small slot 12 further includes an extended portion 121 which has a width smaller than that of the small slot 12. Each slot 11 and 12 is lengthwise extended from an upper end to a lower end of the mounting plate 10. The slot 12 has a width having a size smaller than that of the diameter of the shaft 70 so that when the shaft 70 is assembled with the mounting plate 10 only the locking tab 71 and the neck 73 can be extended through the slot 11 defined in the mounting plate 10.

Figure 4:
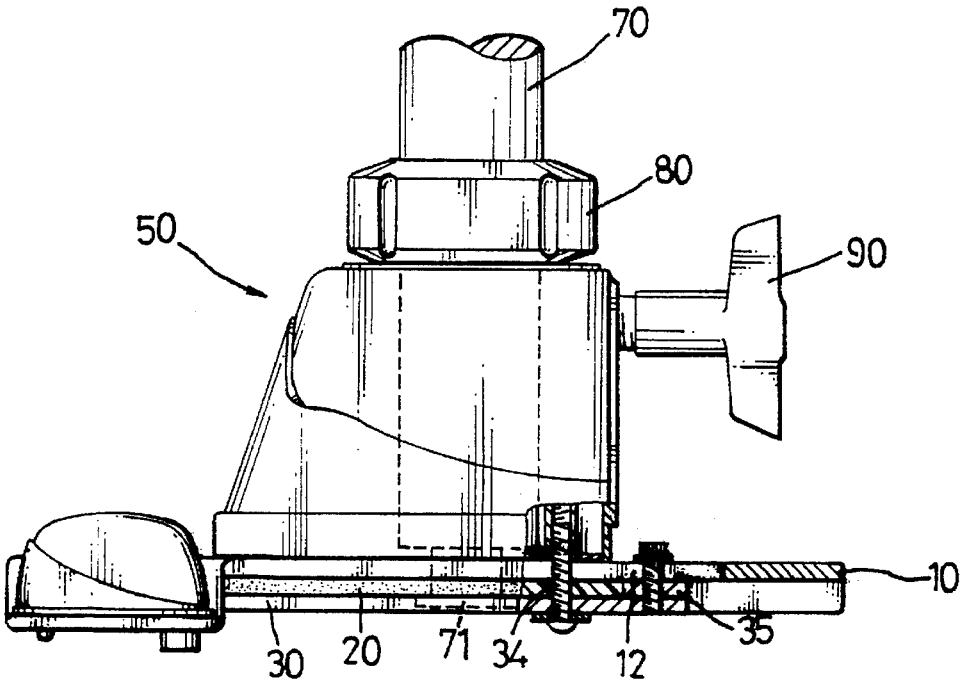
FIG. 4 is a side view of FIG. 3 with a part cut away in which the tension fittings are removed for clarity.

When assembling the tom-tom holder 1, also referring to FIG. 4, firstly two rivets 28 are used to be inserted into the locking plate 24 defining the holes 27 and the fastening plate 20 defining the holes 23 and distal tips of the rivets are deformed so that the locking plate 24 and the fastening plate 20 are fixedly connected together, in which the holes 21 and 25 respectively of the fastening plate 20 and the locking plate 24 are aligned with each other.

Then four screws 34 (only three being shown on FIG. 1) are used to extend sequentially and respectively through four washers 341, the four holes 31 in the fastening strips 30, the first holes 22 in the fastening plate 20, the small slots 12 in the mounting plate 10, and the four holes 42 in the gasket 40 to finally threadedly engage with the cap 50 defining four threaded holes (not labeled) in a bottom thereof (better seen in FIG. 4) thereby to connect the fastening strips 30, fastening plate 20, mounting plate 10, gasket 40, and cap 50 together. Then, two screws 36 are each used to extend respectively through two washers 361 and the extended portions 12 of the slots 12 to threadedly engage with the threaded holes 35 defined by the blocks 33 and the fastening strips 30 thereby to connect the mounting plate 10 and the fastening strips 30 together.

Since the screws 36 each have a diameter smaller than a width of the extended portion 121 and do not tightly connect the mounting plate 10 and the fastening strips 30 together and since the screws 34 each have a diameter smaller than a width of the slots 12 and do not tightly connect the fastening strips 30, fastening plate 20, mounting plate 10, gasket 40, and cap 50 together, the mounting plate 10 can have a movement along a direction that the slots 12 are extended relative to the locking plate 24, the fastening strips 30, the fastening plate 20, the gasket 40 and the cap 50.

Thereafter, the bushing 60 is fitted onto the cap 50 defining the central hole 51. The bushing 60 has an inner diameter having a size meeting that of the diameter of the shaft 70 so that the shaft 70 can be fittingly received in the bushing 60.

After the bushing 60 is fitted onto the cap 50 the shaft 70 is brought to be assembled into the tom-tom holder 1 by extending the bottom of the shaft 70, which defines the locking tab 71 through the bushing 60, the gasket 40 defining the central hole 41, the mounting plate 10 defining the large slot 11, the fastening plate 20 defining the central hole 21 and the locking plate 24 defining the central hole 24 until the locking tab 71 reaches a position in which its upper end and lower end neighbor two protrusions 26 formed on a bottom face of the locking plate 24 and located around an upper end and lower end of central hole 25. When the locking tab 71 reaches the above mentioned position, the threaded portion 72 should have at least a portion located above the bushing 60.

Then the shaft 70 is rotated about 90 degrees so that the upper and lower ends of the locking tab 71 are now located under the bottom face of the locking plate 24 defining two sides of the central hole 25. Thereafter, the locking nut 80 is brought to be screwed onto the threaded portion 72 of the shaft 70 to exert a clamping force between the locking nut 80 and the locking tab 71 thereby to tightly and fixedly connect the above mentioned members for constituting the tom-tom holder 1 in accordance with the present invention together. Finally, a wing screw 90 is used to be screwed through a threaded hole (not shown) defined on the cap 10 to exert a pushing force on the bushing 60 thereby to enable the bushing 60 to tightly engage with the shaft 70 to complete the assembly of the tom-tom holder 1 in accordance with the present invention.

Figure 3:
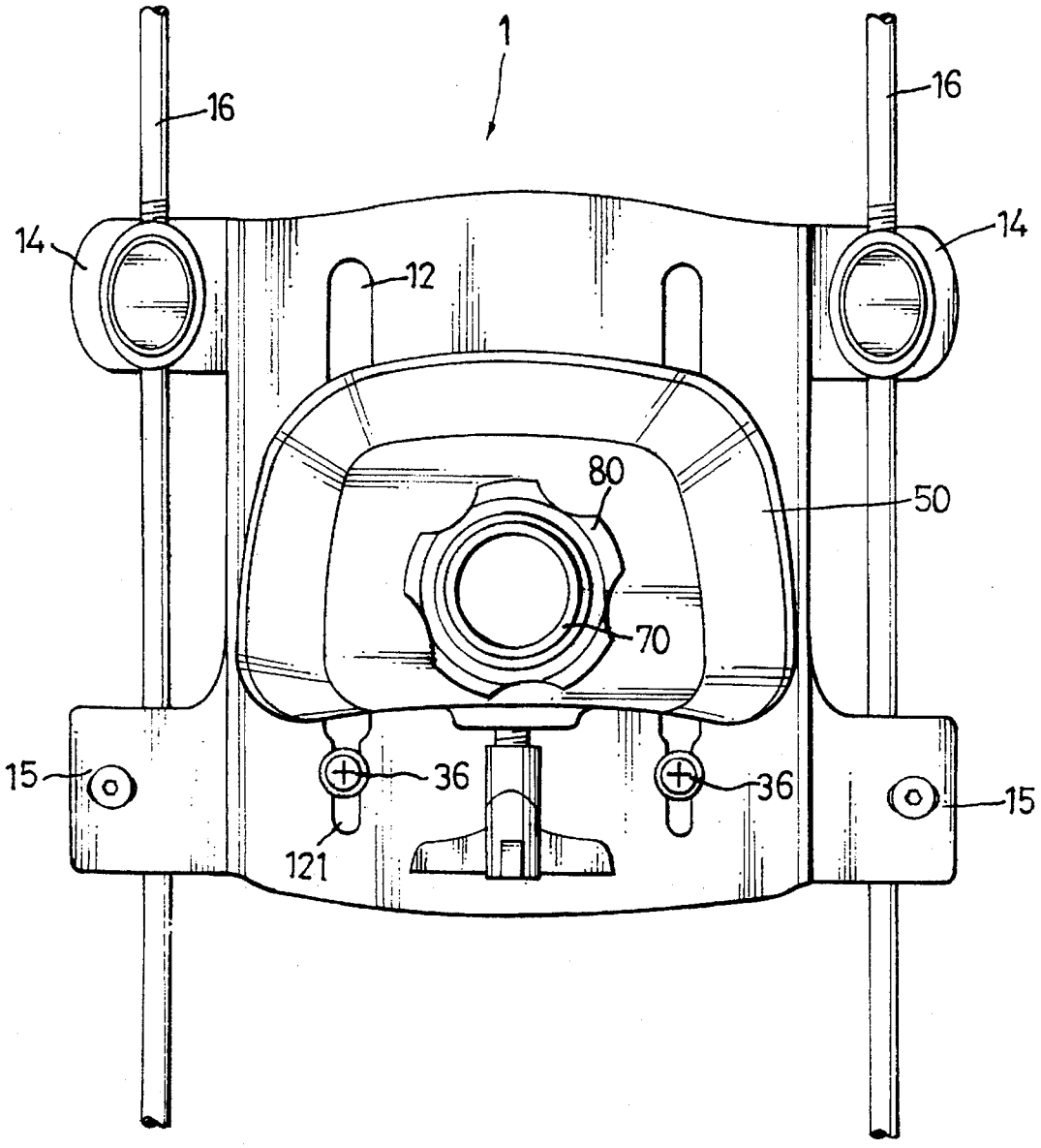
FIG. 3 is a view similar to that of FIG. 2 but in an enlarged scale and that the drum is removed for more clearly showing the tom-tom holder in accordance with the present invention.

Thereafter, as mentioned above and referring to FIGS. 2 and 3, the tom-tom drum 2 can be fixedly mounted on the tom-tom holder 1 by fixedly connecting the tensioning fittings 16 of the tom-tom drum 2 with the ears 14, 15 of tom-tom holder 1 by a known means. Since such a means for connecting the ears 14, 15 of the mounting plate 10 and the tension fittings 16 of the drum 2 is well known by those skilled in the art and is not concerned with the scope of the present invention, a detailed description thereof is omitted.

The remaining portion of the shaft 70 not shown in the drawings can be connected to a second tom-tom holder for a second tom-tom drum and a bracket for mounting these two tom-tom drums on a bass drum.

When the user wants to adjust the level of the tom-tom drum 2 relative to the bass drum, all the user has to do is to loosen the locking nut 80 and then move the drum 2 together with the mounting plate 10 relative to the shaft 70 to reach a required level and finally re-lock the locking nut 80 to tightly and fixedly connect the mounting plate 10 and the other members for constituting the tom-tom holder 1 together.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tom-tom holder comprising:

a mounting plate comprising upper ears and lower ears for fixedly mounting the tom-tom holder to a tensioning fitting of a tom-tom drum, a central slot and at least one side slot extending in a direction from the upper ears to the lower ears;

a cap;

a fastening plate;

a locking plate fixedly attached to the fastening plate;

at least one screw movably attaching the cap and the fastening plate on the mounting plate by extending the screw through the fastening plate, the side slot of the mounting plate to be threadedly engaged with the cap;

a shaft for connecting the tom-tom holder to another tom-tom holder and a bass drum, the shaft defining a bottom locking tab and a threaded portion, and the shaft being extended through the cap, the central slot of the mounting plate, the fastening plate and the locking plate to reach a position in which the locking tab is located on a bottom face of the locking plate and a part of the threaded portion defined on the shaft is located above the cap; and a locking nut threadedly engaging with the threaded portion of the shaft to exert a clamping force between the locking nut and the locking tab to fixedly and tightly connect the cap, the mounting plate and the fastening plate together.

2. The tom-tom holder in accordance with claim 1 further comprising a gasket located between the cap and the mounting plate.

3. The tom-tom holder in accordance with claim 1 further comprising a bushing fitted on the cap, said shaft being extended through the bushing.

4. The tom-tom holder in accordance with claim 3 further comprising at least one screw threadedly engaging with the cap and exerting a pushing force on the bushing so that the sleeve is tightly enlarged with the shaft.

5. The tom-tom holder in accordance with claim 1 further comprising at least one fastening strip and wherein the screw for movably connecting the fastening plate, the mounting plate and the cap together is extended through the fastening strip, the fastening plate, the side slot of the mounting plate to be threadedly engaged with the cap.

6. The tom-tom holder in accordance with claim 5 further comprising a block fixedly attached on an end of the fastening strip, an extended portion being integrally formed with the side slot of the mounting plate and a screw movably attaching the fastening strip on the mounting plate by extending the screw through the extended portion to be threadedly engaged with the block.

7. The tom-tom holder in accordance with claim 1, wherein the locking tab has a rectangular shape.

* * * * *